US008128432B2

(12) United States Patent
Jaouen et al.

(10) Patent No.: US 8,128,432 B2
(45) Date of Patent: Mar. 6, 2012

(54) INSERT AND METHOD OF ASSEMBLING SUCH AN INSERT

(75) Inventors: Jean-Marc Jaouen, La Sone (FR); Didier Revol, Chatte (FR); Vincent Laroche, Joue en Charnie (FR); Nathalie Foratier, Saint Antoine l'Abbaye (FR); Jean-Pierre Cousy, Chevrieres (FR)

(73) Assignees: Legrand France, Limoges (FR); Legrand SNC, Limoges (FR)

( * ) Notice: Subject to any disclaimer, the term of this patent is extended or adjusted under 35 U.S.C. 154(b) by 0 days.

(21) Appl. No.: 13/055,978

(22) PCT Filed: Jul. 28, 2009

(86) PCT No.: PCT/FR2009/051517

§ 371 (c)(1),
(2), (4) Date: Jan. 26, 2011

(87) PCT Pub. No.: WO2010/012954

PCT Pub. Date: Feb. 4, 2010

(65) Prior Publication Data

US 2011/0136382 A1 Jun. 9, 2011

(30) Foreign Application Priority Data

Jul. 28, 2008 (FR) ..... 08 55178

(51) Int. Cl.
*R01R 13/73* (2006.01)

(52) U.S. Cl. ..... 439/620.01

(58) Field of Classification Search ..... 439/894.1, 439/941, 676, 344, 620.01
See application file for complete search history.

(56) References Cited

U.S. PATENT DOCUMENTS

| | | | | |
|---|---|---|---|---|
| 5,547,405 | A | 8/1996 | Pinney et al. | |
| 5,769,647 | A | 6/1998 | Tulley et al. | |
| 5,967,828 | A | 10/1999 | Geurts et al. | |
| 6,332,810 | B1 | 12/2001 | Bareel | |
| 6,409,547 | B1 | 6/2002 | Reede | |
| 7,112,074 | B2 * | 9/2006 | Nakai et al. | 439/159 |
| 7,220,149 | B2 * | 5/2007 | Pharney | 439/676 |
| 7,265,300 | B2 * | 9/2007 | Adriaenssens et al. | 174/258 |
| 7,337,683 | B2 * | 3/2008 | DeFriez et al. | 73/863.23 |

(Continued)

OTHER PUBLICATIONS

International Search Report, dated Dec. 10, 2009, from corresponding PCT application.

*Primary Examiner* — Tulsidas C Patel
*Assistant Examiner* — Phuong Nguyen
(74) *Attorney, Agent, or Firm* — Young & Thompson

(57) ABSTRACT

The insert includes at least three contacts having essentially linear parts and at least one three-pole capacitance between three of the contacts. One of the contacts of each three-pole capacitance is connected to a central armature. A first dimension of the central armature, in the direction perpendicular to the substantially linear parts, is greater than a second dimension, in a direction parallel to the substantially linear parts, the second dimension defining the widths of the zones of the central armature. The mean width of the central armature, between the zones where it faces other armatures, connected to the other contacts of the three-pole capacitance, is greater than one third of the mean length of the central armature in these regions. Preferably, in at least one three-pole capacitance, the mean width of the central armature between the regions where it faces the lateral armatures is greater than one third of the distance between the lateral armatures.

22 Claims, 8 Drawing Sheets

U.S. PATENT DOCUMENTS

| | | | | |
|---|---|---|---|---|
| 7,819,703 | B1 * | 10/2010 | Walker et al. | 439/676 |
| 2001/0016455 | A1 | 8/2001 | Reichle | |
| 2001/0018288 | A1 * | 8/2001 | Nicholls | 439/402 |
| 2002/0019172 | A1 | 2/2002 | Forbes et al. | |
| 2002/0081908 | A1 | 6/2002 | Ahn et al. | |
| 2006/0121788 | A1 * | 6/2006 | Pharney | 439/676 |
| 2007/0015417 | A1 * | 1/2007 | Caveney et al. | 439/676 |
| 2008/0305692 | A1 * | 12/2008 | Little et al. | 439/676 |
| 2010/0273359 | A1 * | 10/2010 | Walker et al. | 439/676 |

* cited by examiner

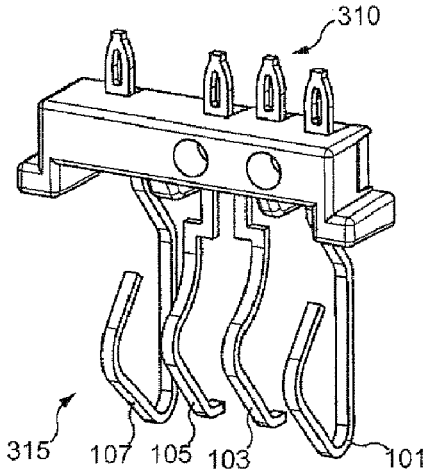
Fig. 3A
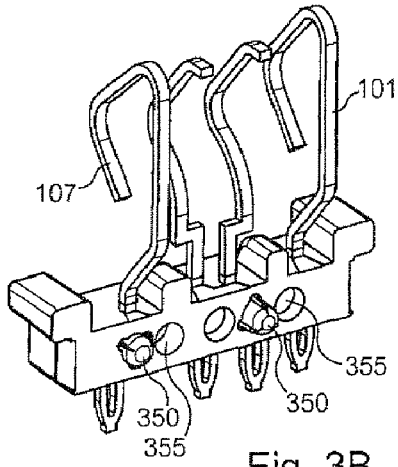
Fig. 3B
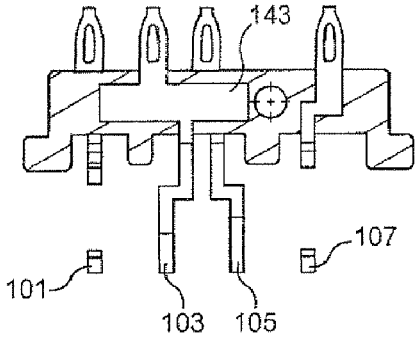
Fig. 3D
Fig. 3E
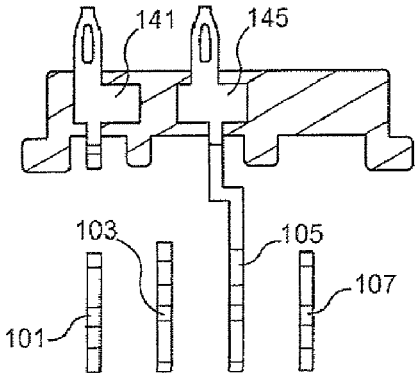
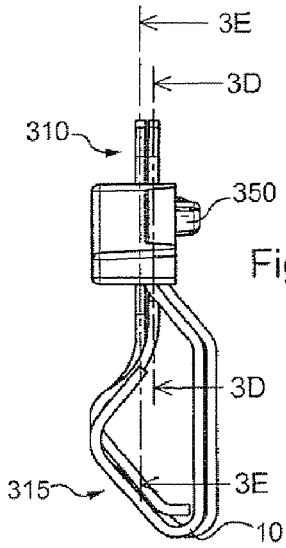
Fig. 3C

INSERT AND METHOD OF ASSEMBLING SUCH AN INSERT

FIELD OF THE INVENTION

The present invention concerns an insert and a method of assembling such an insert. It is applied, in particular, to inserts for the connection of electronic or information technology systems, notably inserts of type RJ45 (RJ stands for Registered Jack).

TECHNOLOGICAL BACKGROUND

A plug is designed, by insertion into an insert or socket, to make the electrical connection between electrical lines present on the one hand in the plug and on the other hand in the insert. During this insertion, plates of the plug come to bear on respective corresponding or homologous contacts of the insert. The electrical lines and the parallel plates being close together, electromagnetic induction effects cause crosstalk, i.e. interference with signals on one line by signals on adjacent lines.

In order to minimize crosstalk, twisted pairs are used in cables used to transmit data in telephone and information technology networks, for example. However, one type of local crosstalk, said "line termination", or NEXT (Near End CrossTalk), remains present.

At high frequencies, a capacitance effect between the parallel plates of the plug causes what is called "near-end crosstalk".

To reduce this interference, the RJ45 CAT6A standard, which concerns 10 Gbit/s networks, imposes near-end crosstalk isolation, namely:

near-end crosstalk isolation at 100 MHz: 54 dB,
near-end crosstalk isolation at 250 MHz: 46 dB, and
near-end crosstalk isolation at 500 MHz: 37 dB.

An RJ45 connector is a physical interface often used to terminate twisted-pair cables. It includes eight electrical connection pins.

The ISO IEC 11801 standard (amendment 1 and amendment 2, in process) defines the performance of a transmission channel.

The document U.S. Pat. No. 5,547,405 describes means for reducing crosstalk on the side of the insert. Thus this document provides in an insert including four contacts a lateral extension (114) starting from the first contact (B) and passing in front of the second (A) to lie in front of the third (C). The capacitance created between the third and fifth contacts compensates the capacitance of the plug causing the crosstalk. Similarly, a lateral extension (124) starts from the fourth contact (D), passes in front of the third (C) and lies in front of the second (B) to produce compensation capacitance there. In the case of an insert including eight contacts (see FIGS. 8 and 9 of the present application), the above document has four compensation capacitances (16A, 16B, 16C and 16D) formed in the same manner by lateral extensions 3 and 6 on either side of the third and sixth contacts.

This technical solution has numerous drawbacks. As shown in FIG. 8 of the above document, it causes respective stray inductances Lp3 and Lp6 in the fine connections that link the contact to each of its lateral extensions, which adds crosstalk between the signals, notably inductive crosstalk. Moreover, these fine connections and the contact that they cross form stray capacitances which increase the crosstalk between the signals.

The document US 2002/0081908 concerns a low-crosstalk insert. As shown in FIGS. 15a to 17 of that document, the second preferred embodiment includes two half-inserts (120a and 120b) separated by a layer (142) of air that surrounds on the one hand the even-numbered conductors (120a) and on the other hand the odd-numbered conductors (120b).

In each of these half-inserts, capacitances are formed between three conductors (T2, T3, T4 and R1, R3, R2) because of local deformations of the conductors called "protrusions". As shown in FIG. 17, the central conductor (T3, R3) has two lateral extensions that face respective lateral extensions of the other conductors.

However, because of the 8-shaped central contact, an unwanted inductive effect is produced on each of the connections between the lateral extensions. The third embodiment of the above document seeks to reduce these inductive effects.

The present invention aims to remedy the above drawbacks.

OBJECT OF THE INVENTION

To this end, a first aspect of the present invention provides an insert including at least three contacts having substantially linear parts which further includes at least one three-pole capacitor between three of said contacts, one of the contacts of each three-pole capacitor being connected to a central plate, a first dimension of the central plate in the direction perpendicular to said substantially linear parts being greater than a second dimension in a direction parallel to said substantially linear parts, said second dimension defining the widths of the areas of said central plate, the average width of said central plate between the areas in which said central plate faces other plates, referred to as "lateral" plates, connected to the other contacts of said three-pole capacitor being greater than one third of the average width of said central plate in said areas.

These arrangements reduce or even eliminate the inductance created by the connections with the superposed areas of the capacitor plates. This kind of three-pole capacitor is characterized by the virtually total absence of inductive effects between the two lateral plates facing the single central plate.

According to preferred features, in at least one three-pole capacitor, the average width of said central plate, between the areas in which it faces the lateral plates, is greater than one third of the distance between the lateral plates.

According to preferred features, in at least one three-pole capacitor the minimum width of said central plate between the areas in which said central plate faces the lateral plates is greater than one third of the average width of said central plate in said areas.

According to preferred features, in at least one three-pole capacitor the minimum width of said central plate between the areas in which it faces the lateral plates is greater than one third of the distance between the lateral plates.

According to preferred features, in at least one three-pole capacitor the average width of said central plate between the areas in which said central plate faces the lateral plates is greater than half the average width of said central plate in said areas.

According to preferred features, in at least one three-pole capacitor the average width of the central plate between the areas in which it faces the lateral plates is greater than two thirds of the average width of said plate in said areas.

According to preferred features, in at least one three-pole capacitor the average width of the central plate between the areas in which it faces the lateral plates is equal to the average width of said plate in said areas.

According to preferred features, in at least one three-pole capacitor the average width of said central plate between the areas in which it faces the lateral plates is greater than half the distance between the lateral plates.

According to preferred features, in at least one three-pole capacitor the average width of said central plate between the areas in which it faces the lateral plates is greater than two thirds of the distance between the lateral plates.

According to preferred features, in at least one three-pole capacitor the average width of said central plate between the areas in which it faces the lateral plates is greater than or equal to the distance between the lateral plates.

According to preferred features, in at least one three-pole capacitor the minimum width of said central plate between the areas in which said central plate faces the lateral plates is greater than half the average width of said central plate in said areas.

According to preferred features, in at least one three-pole capacitor the width of the central plate between the areas in which it faces the lateral plates is greater than two thirds of the average width of said plate in said areas.

According to preferred features, in at least one three-pole capacitor the minimum width of the central plate between the areas in which it faces the lateral plates is equal to the average width of said plate in said areas.

According to preferred features, in at least one three-pole capacitor the minimum width of said central plate between the areas in which it faces the lateral plates is greater than half of the distance between the lateral plates.

According to preferred features, in at least one three-pole capacitor the average width of said central plate between the areas in which it faces the lateral plates is greater than two thirds of the distance between the lateral plates.

According to preferred features, in at least one three-pole capacitor the average width of said central plate between the areas in which it faces the lateral plates is greater than or equal to the distance between the lateral plates.

According to preferred features, in at least one three-pole capacitor the central plate is solid.

Each of these features strengthens the reduction of the inductive effect.

According to preferred features, the insert of the present invention as succinctly described hereinabove includes at least five consecutive contacts and at least one three-pole capacitor between the first, third and fifth contacts.

According to preferred features, the insert of the present invention as succinctly described hereinabove includes eight consecutive contacts and at least one three-pole capacitor between the fourth, sixth and eighth contacts.

According to preferred features, the insert includes means for separating the contacts into two spaced contact groups, one of the groups including the even-number contacts and the other including the odd-number contacts.

Thanks to these features, because the successive contacts are in different contact groups, they are far apart and therefore produce only a negligible capacitance between them.

According to preferred features, at least one three-pole capacitor includes a dielectric film placed between the plates.

A second aspect of the present invention provides a method of assembling an insert that includes a step of assembling at least three contacts having substantially linear parts, which further includes a step of producing at least one three-pole capacitor between three of said contacts, one of the contacts of each three-pole capacitor being connected to a central plate, a first dimension of the central plate in the direction perpendicular to said substantially linear parts being greater than a second dimension in a direction parallel to said substantially linear parts, said second dimension defining the widths of the areas of said central plate, the average width of said central plate between the areas in which said central plate faces other plates, known as "lateral" plates, connected to the other contacts of said three-pole capacitor being greater than one third of the average width of said central plate in said areas.

The advantages, objects and features of this method being similar to those of the insert of the present invention as succinctly described hereinabove, they are not repeated here.

BRIEF DESCRIPTION OF THE DRAWINGS

Other advantages, objects and features of the present invention emerge from the following description given by way of nonlimiting explanation with reference to the appended drawings, in which:

FIGS. 3A to 3E are two perspective views, a side view and two sectional views of a first half-insert of the insert shown in FIG. 2, FIGS. 4A to 4E are two perspective views, a side view and two sectional views of a second half-insert of the insert shown in FIG. 2.

DETAILED DESCRIPTION OF ONE EMBODIMENT

Figure 1:
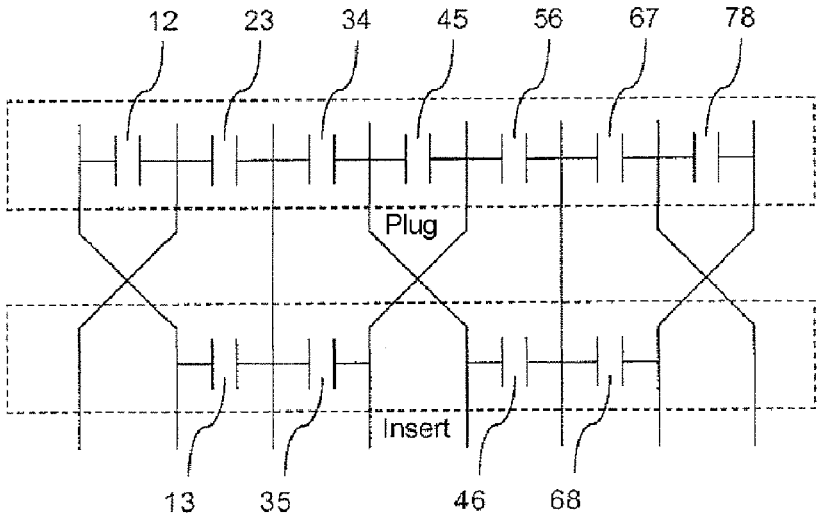
FIG. 1 is a theoretical circuit diagram of crosstalk compensation for an insert conforming to the RJ45 standard.

As seen in FIG. 1, in a plug with eight plates designed to come to bear on eight contacts of an insert:

- the capacitor 23 produced by the area of the second plate facing the third plate is responsible for the intrinsic crosstalk of the plug between the contact pair comprising the first and second contacts and the contact pair comprising the third and sixth contacts,
- the capacitor 67 produced by the area of the sixth plate facing the seventh plate is responsible for the intrinsic crosstalk of the plug between the contact pair comprising the seventh and eighth contacts and the contact pair comprising the third and sixth contacts,
- the capacitors 34 and 56 respectively produced on the one hand between the third and fourth contacts and on the other hand between the fifth and sixth contacts are responsible for the intrinsic crosstalk of the plug between the contact pair comprising the fourth and fifth contacts and the contact pair comprising the third and sixth contacts.

The theoretical circuit diagram of crosstalk compensation for a plug conforming to the RJ45 standard includes in an insert a capacitor 13 between the first and third contacts, a capacitor 35 between the third and fifth contacts, a capacitor 46 between the fourth and sixth contacts, and a capacitor 68 between the sixth and eighth contacts.

In particular:

the capacitor 13 compensates the capacitor 23 in order to reduce the crosstalk between the contact pair comprising the first and second contacts and the contact pair comprising the third and sixth contacts, the capacitor 68 compensates the capacitor 67 in order to reduce the crosstalk between the contact pair comprising the seventh and eighth contacts and the contact pair comprising the third and sixth contacts, the capacitors 35 and 46 respectively compensate the capacitors 34 and 56 in order to reduce the crosstalk between the contact pair comprising the fourth and fifth contacts and the contact pair comprising the third and sixth contacts.

Capacitive coupling in the plug is thus compensated by capacitive coupling in the insert. The closer the compensation capacitive couplings of the insert to the capacitors of the plug, the higher the performance of the pair formed by the insert and the plug. The conductors situated between the capacitive couplings of the plug and the compensation capacitive couplings of the insert introduce inductances that compromise the required compensation. To effect that compensation, the intrinsic capacitive couplings of the plug and the compensation couplings produced in the insert are balanced.

Figure 2:
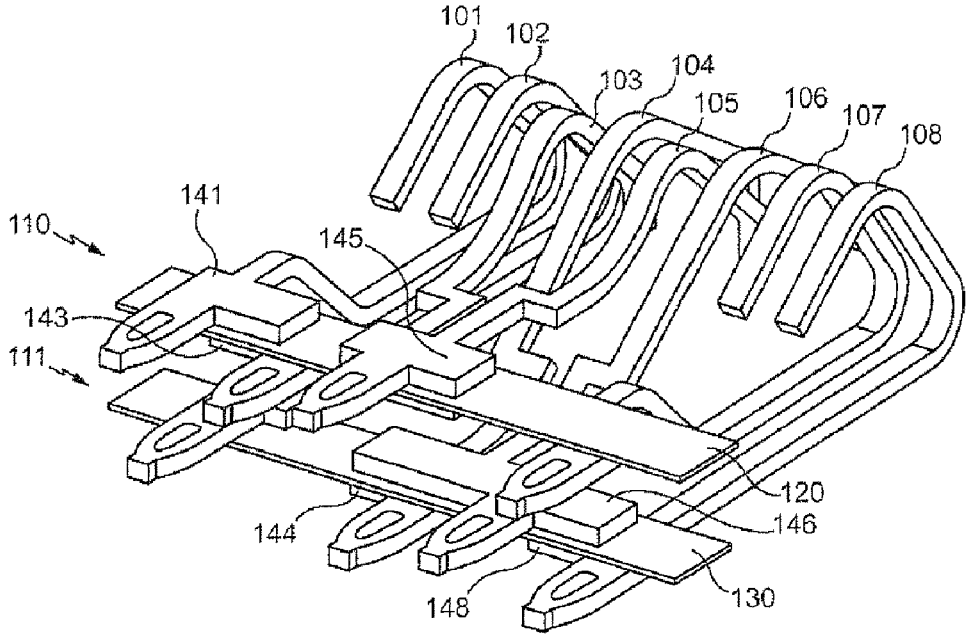
FIG. 2 represents diagrammatically the positions of the contacts of one particular embodiment of the insert of the present invention.

By way of explanation, FIG. 2 shows only the conductive parts of one particular embodiment of an insert of the present invention.

There are seen in FIG. 2 eight contacts consecutively referenced 101 to 108. These contacts are divided into two contact groups 110 and 111 respectively comprising the contacts with odd-number references 101, 103, 105 and 107 and the contacts with even-number references 102, 104, 106 and 108.

The contacts have substantially linear parts that are substantially parallel and define a first direction that is perpendicular to the substantially linear parts and horizontal in FIGS. 3D, 3E, 4D and 4E and a second direction that is parallel to these substantially linear parts and vertical in FIGS. 3D, 3E, 4D and 4E.

In the first group of contacts 110 a dielectric film 120 separates the contacts 101 and 105 at the top and the contact 103 at the bottom. The contacts 101 and 105 have respective rectangular lateral extensions 141 and 145 extending along the dielectric film 120. The contact 103 has rectangular lateral extensions 143 extending along the dielectric film 120 to form a three-pole capacitor with the contacts 101 and 105 and their lateral extensions 141 and 145.

The contact 103 and its lateral extensions 143 form a central plate of this three-pole capacitor. The contact 101 and its lateral extension 141 form a first lateral plate. The contact 105 and its lateral extension 145 form a second lateral plate.

A first dimension or length of the central plate measured in the first direction, which is horizontal in FIGS. 3D, 3E, 4D and 4E, is greater than a second dimension measured in the second direction, which is vertical in FIGS. 3D, 3E, 4D and 4E. The second dimension defines the "width" of the areas of the central plate referred to hereinafter.

The average width of the central plate between the areas in which said central plate faces the lateral plates is preferably greater than, in order of increasing preference, one third, half, two thirds and three quarters of the average width of said central plate in said areas. Even more preferably, the average width of the central plate between the areas in which said central plate faces the lateral plates is greater than or equal to the average width of the central plate in these areas.

As in the embodiment described here, the average widths are preferably the minimum widths because the latter are constant. Thus the minimum width of the central plate between the areas in which said central plate faces the lateral plates is preferably greater than, in order of increasing preference, one third, half, two thirds and three quarters of the average width of said central plate in said areas. Even more preferably, the minimum width of the central plate between the areas in which said central plate faces the lateral plates is greater than or equal to the average width of the central plate in these areas.

Figure 8:
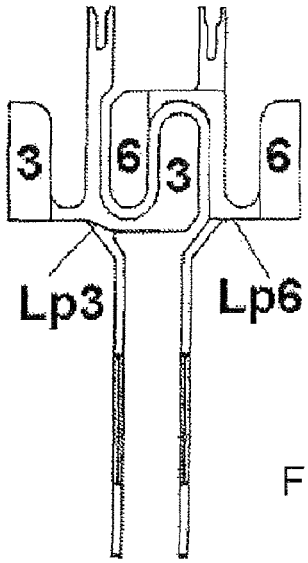
FIG. 8 represents contacts provided with lateral extensions of the insert described in the document U.S. Pat. No. 5,547,405.
Figure 9:
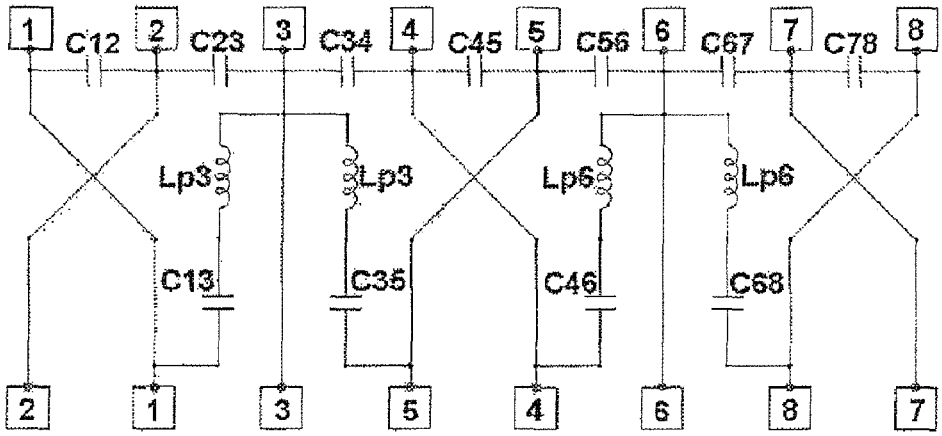
FIG. 9 is the equivalent electrical circuit diagram of the insert described in the document U.S. Pat. No. 5,547,405.

In the embodiment described with reference to the figures, the minimum width and the average width of the central plate between the areas in which said central plate faces the lateral plates are preferably equal to the average width of said central plate in said areas. Conversely, in the insert shown in FIGS. 8 and 9 (relating to the prior art document U.S. Pat. No. 5,547,405), the minimum width of the electrical connection between the two plates of the capacitors 3 (respectively 6) is approximately one fifth of the average width of the plates of the capacitors 3 (respectively 6), which produces a non-negligible inductive effect.

The average width of the central plate between the areas in which it faces the lateral plates is preferably, in order of increasing preference, greater than one third, half, two thirds of the distance between the lateral plates. Even more preferably, the average width of the central plate between the areas in which it faces the lateral plates is greater than or equal to the distance between the lateral plates.

As in the embodiment described, the average widths are preferably the minimum widths because the latter are constant. Thus the minimum width of the central plate between the areas in which it faces the lateral plates is preferably, in order of increasing preference, greater than one third, half, two thirds of the distance between the lateral plates. Even more preferably, the minimum width of the central plate between the areas in which it faces the lateral plates is greater than or equal to the distance between the lateral plates.

A three-pole capacitor of this kind is characterized by the practically total absence of inductive effect between the two parallel plates facing a single plate.

The contact 107 is located relative to the dielectric film 120 on the same side as the contact 103.

In the second group 111 of contacts, a dielectric film 130 separates the contacts 104 and 108 at the bottom and the contact 106 at the top. The contacts 104 and 108 have respective rectangular lateral extensions 144 and 148 extending along the dielectric film 130. The contact 106 has rectangular lateral extensions 146 extending along the dielectric film 130 to form a three-pole capacitor with the contacts 104 and 108 and their lateral extensions.

A three-pole capacitor identical to that formed between the contacts 101, 103 and 105 is formed between the contacts 104, 106 and 108.

The contact 102 is located relative to the dielectric film 130 on the same side as the contact 106.

It is seen in FIG. 2 that the contacts of the insert extend differently from their area facing the dielectric film 120 in order to form the area of contact with the homologous plate of the plug.

Thus the contact 101 descends to the plane of the dielectric film 130. The contacts 101 and 102 are then parallel to each other and, after a curved area defining an acute angle, return toward the rear end of the insert where they form their curved area of contact defining an obtuse angle.

The contact 107 descends to the plane of the dielectric film 130. The contacts 107 and 108 are then parallel to each other and to the contacts 101 and 102.

The contact 103 and the contact 105 are substantially parallel and have a curved contact area defining an obtuse angle.

The contact 104 and the contact 106 are substantially parallel and have a curved contact area defining an obtuse angle.

These obtuse angles are chosen to maximize the distances between the consecutive contacts. Thus the capacitances between the consecutive contacts are reduced, which limits the crosstalk generated by these stray capacitances.

Similarly, because the contacts 102 and 103, respectively 106 and 107, have very different shapes, the capacitance between them is minimized.

Each of the groups of spaced contacts respectively comprising the contacts with even-number references and the contacts with odd-number references thus comprise four contacts of which three produce, with conductive lateral extensions, a three-pole capacitor. In some embodiments a dielectric layer, for example a polyimide film, is provided to separate the plates of each three-pole capacitor.

Using multipole capacitors has the advantage of eliminating the stray inductances of the connections between capacitors. Suppressing these stray inductances enhances compensation, the effect of which is to improve performance by increasing the bandwidth of the product and the isolation between pairs.

Because each lateral extension is of rectangular parallelepiped shape, its inductance is reduced relative to a shape including a thinner intermediate part.

As seen in FIGS. 3A to 4E, the insert shown in FIG. 2 is constructed by assembling, in particular, two sub-assemblies referred to somewhat inaccurately hereinafter as "half-inserts" which each fasten together one of the two groups of contacts formed on the one hand of the even-number contacts and on the other hand of the odd-number contacts.

The first half-insert, shown in FIGS. 3A to 3E, includes a body 305 that joins together the contacts 101, 103, 105 and 107 and the dielectric film 120. Each of the contacts has an end part 310 for connecting it to an electrical line connected to the insert and a longitudinal extension 315 that includes an area of contact with a homologous plate of the corresponding plug.

The longitudinal extensions of the end contacts 101 and 107 include a bend define an acute angle before reaching the contact area. Conversely, the longitudinal extensions of the central contacts 103 and 105 define obtuse angles, including the angle formed in the contact area.

FIGS. 3C to 3E show the shape of the lateral extensions 141, 143 and 145 of the contacts 101, 103 and 105 inside the body 305. As seen in FIG. 3E, the contact 103 has two lateral extensions 143 respectively extending toward the contacts 101 and 105. Similarly, the contact 101 has a lateral extension 141 extending toward the contact 103. Finally, the contact 105 has a lateral extension 145 extending toward the contact 103. Electrical insulation between these lateral extensions 141 and 145 on the one hand and the lateral extensions 143 on the other hand results in a three-pole capacitor.

The second half-insert, shown in FIGS. 4A to 4E, includes a body 405 that joins together the contacts 102, 104, 106 and 108 and the dielectric film 130. Each of the contacts has an end part 410 for connecting it to an electrical line connected to the insert and a longitudinal extension 415 that includes an area of contact with a homologous plate of the corresponding plug.

The longitudinal extensions of the end contacts 102 and 108 feature a bend defining an acute angle before reaching the contact area. Conversely, the longitudinal extensions of the central contacts 104 and 106 define obtuse angles, including the angle formed in the contact area.

Note that, as shown in FIGS. 7A to 7H, which respectively represent the contacts 101 to 108 in their respective half-inserts, the angles defined by the bends in the contact areas of the four central contacts are chosen to increase the distance between those contacts to reduce the stray capacitances that they produce and thus to reduce crosstalk.

Figure 4A:
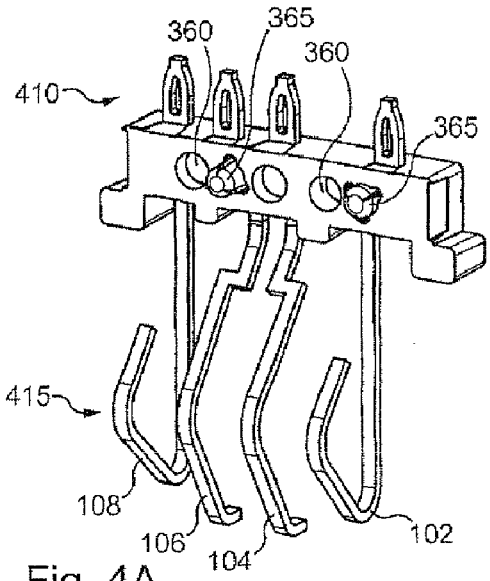
Figure 4B:
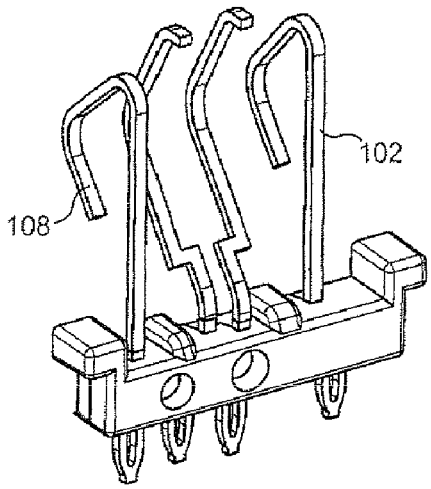
Figure 4D:
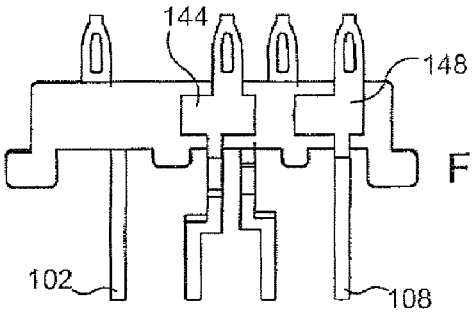
Figure 4E:
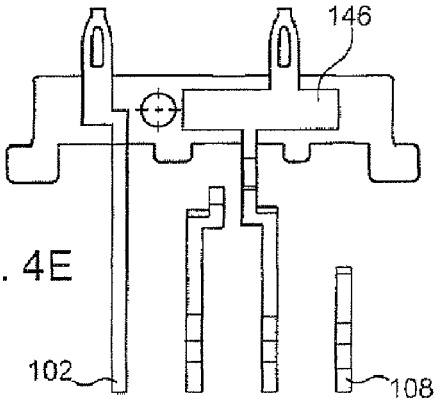
Figure 4C:
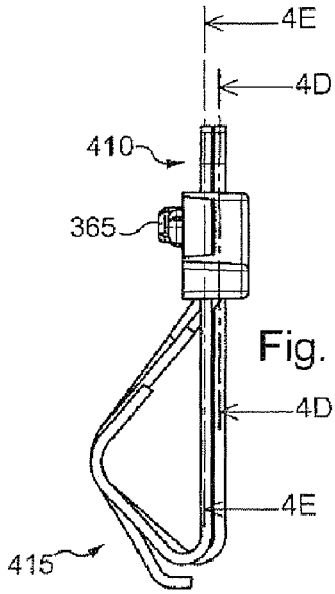

FIGS. 4C to 4E show the shape of the lateral extensions 144, 146 and 148 of the contacts 104, 106 and 108 inside the body 405. As seen in FIG. 4E, the contact 106 has two lateral extensions 146 respectively extending toward the contacts 104 and 108. Similarly, the contact 108 has a lateral extension 148 extending toward the contact 106. Finally, the contact 104 has a lateral extension 144 extending toward the contact 106. A film of dielectric material between these lateral extensions 144 and 148 on the one hand and the lateral extensions 146 on the other hand provides electrical insulation and results in a three-pole capacitor.

It is seen in FIG. 3B that, on the side opposite the contact area side, the first half-insert includes lugs 350 and holes 355 that respectively correspond to holes 360 and lugs 365 on the contact area side in the second half-insert for achieving an accurate assembly of the two half-inserts when constructing the insert (see FIG. 4A).

Figure 5:
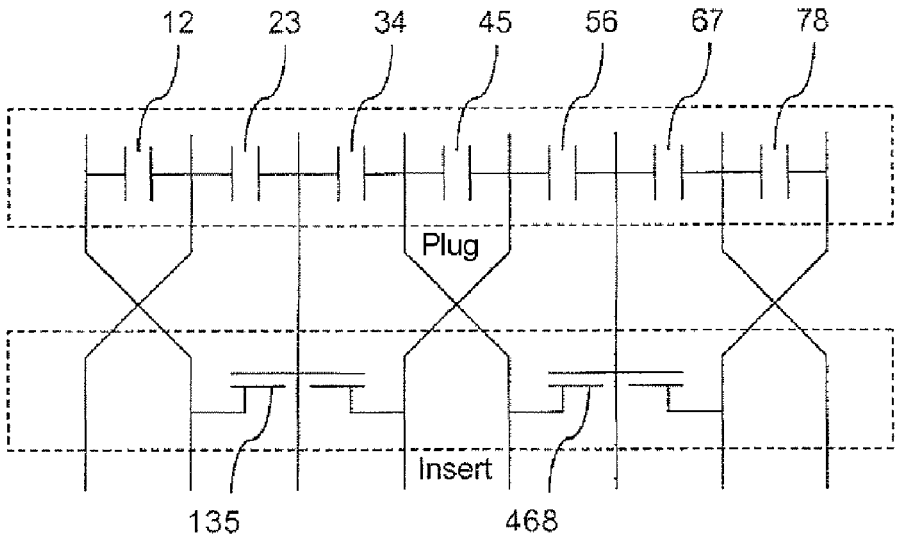
FIG. 5 is an equivalent electrical circuit diagram of the insert shown in FIGS. 2 to 4 with three-pole capacitors.

It is seen in FIG. 5 that the equivalent electrical circuit diagram of the insert shown in FIGS. 2 to 4E includes two three-pole capacitors 135 and 468 respectively formed inside the body 305 of the first half-insert between the lateral extension of the contacts 101, 103 and 105 and in the body 405 of the second half-insert between the lateral extensions of the contacts 104, 106 and 108. These three-pole capacitors have the particular advantage of considerably reducing the problem of stray inductance.

Figure 6:
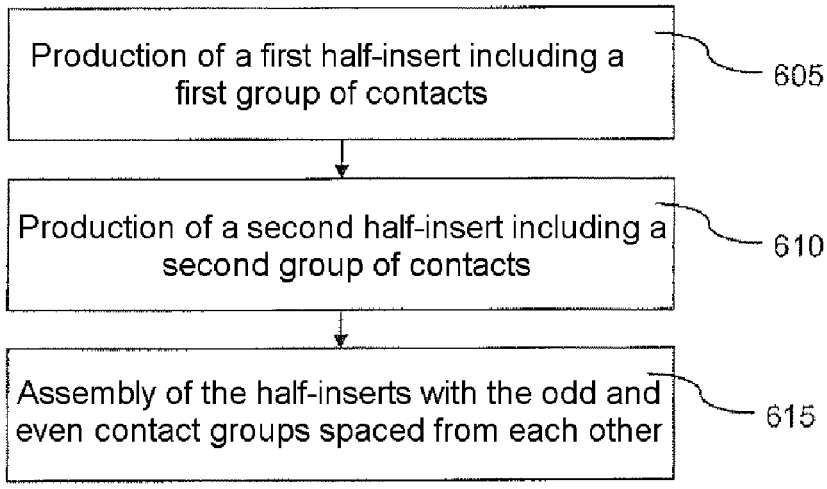
FIG. 6 represents in flowchart form steps of one particular embodiment of the method of the present invention of assembling an insert.
Figure 7A:
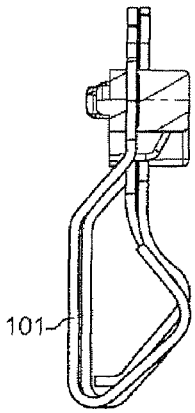
FIGS. 7A to 7H represent the shapes of the longitudinal extensions of the contacts of the insert shown in FIGS. 1 to 5.
Figure 7B:
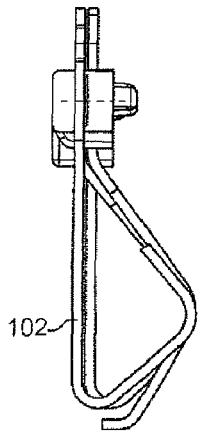
Figure 7C:
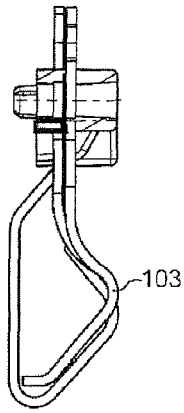
Figure 7D:
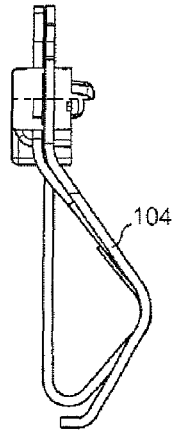
Figure 7E:
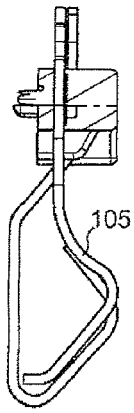
Figure 7F:
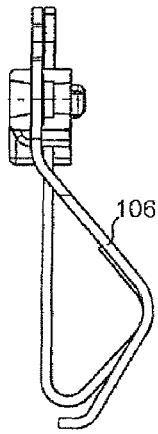
Figure 7G:
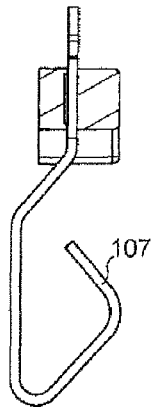
Figure 7H:
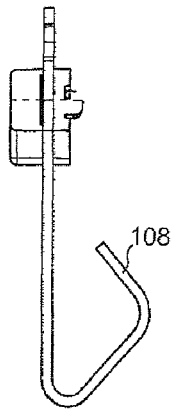

It is seen in FIG. 6 that, to produce an insert of the present invention, there are effected:

- a step 605 of producing a first half-insert mechanically connected to the first group of contacts and to first crosstalk reducing means,
- a step 610 of producing a second half-insert mechanically connected to the second group of contacts and preferably to crosstalk reducing means, and
- a step 615 of assembling the two half-inserts so that the two groups of contacts remain spaced from each other and respectively include the even-number contacts and the odd-number contacts of the assembly of consecutive contacts of the insert.

Figure 10:
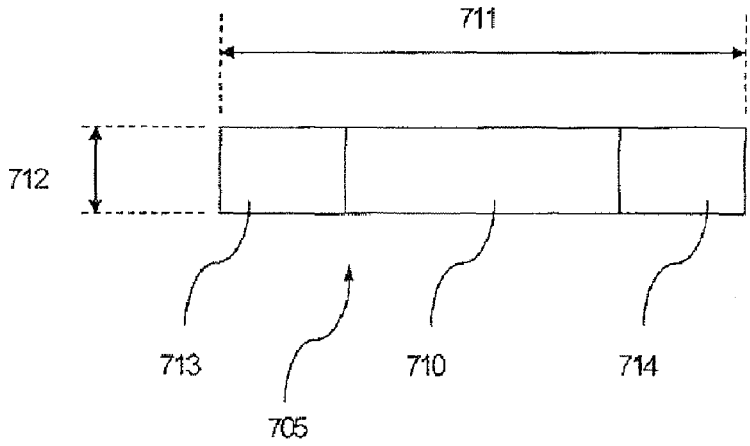
FIG. 10 represents an experimental three-pole capacitor to show the reduced inductive effect obtained.

It is seen in FIG. 10 that the experimental three-pole capacitor 705 used to show the reduced inductive effect obtained has a central plate 710 that is rectangular, extends for example over a length 711 of 6 mm and has a width 712 of 1 mm, and two lateral plates 713 and 714 of length 1.5 mm and of width 1 mm wholly superposed at the ends of the central plate 710.

Figure 11:
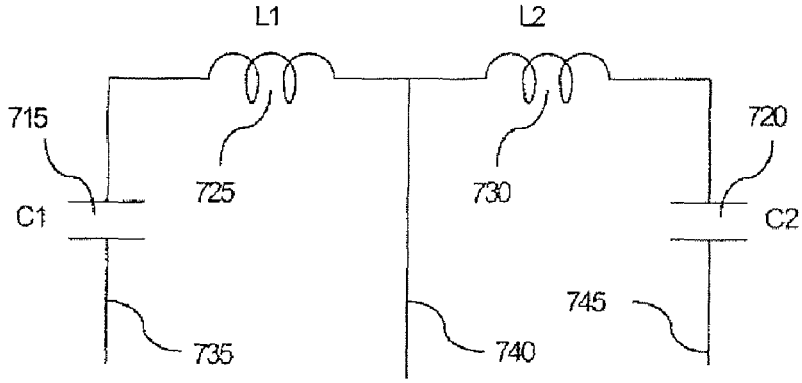
FIG. 11 is the equivalent electrical circuit diagram of the three-pole capacitor shown in FIG. 10.

It is seen in FIG. 11 that the equivalent circuit diagram of this three-pole capacitor consists of two capacitors C1 715 and C2 720 formed by the areas of overlapping of the lateral plates and the central plate 710 separated by two inductors L1 725 and L2 730 formed by the "central" area of the central plate 710 that separates the two areas of overlap with the lateral plates 713 and 714. The contacts 735, 740 and 745 are also represented in FIG. 11.

Figure 12:
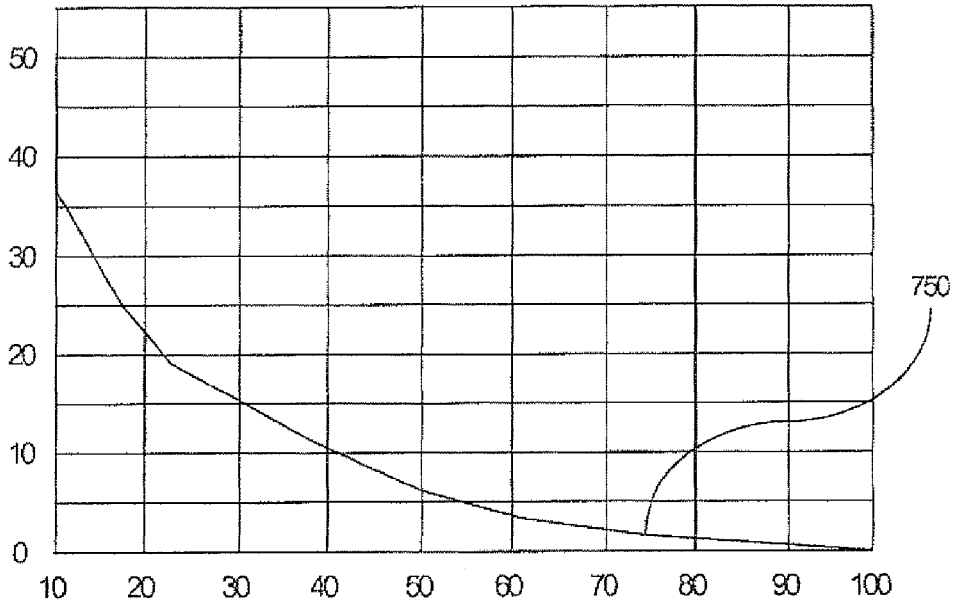
FIG. 12 represents a curve of the increase in the inductance of the central part or connecting area of the three-pole capacitor when the width of the central part is varied.

In an experiment of which one result is shown in FIG. 12, the constant width 712 of the central part was decreased from 1 mm (as shown in FIGS. 10) to 0.1 mm.

The ratio of the resultant width to the initial width is plotted on the abscissa axis and the improvement in the inductance 750 is plotted on the ordinate axis.

It is seen that, starting from 100% (corresponding to a central plate 712 width of 1 mm) and moving toward 10% (corresponding to a central plate width of 0.1 mm), the inductance increases ever more rapidly. At 50%, the increase in the inductance is approximately 6%.

The invention claimed is:

1. Insert including at least three contacts (101 to 108) having substantially linear parts characterized in that it further includes at least one three-pole capacitor (141, 143, 145, 144, 146, 148) between three of said contacts (101, 103, 105, 104, 106, 108), one of the contacts (103, 106) of each three-pole capacitor being connected to a central plate (143, 146), a first dimension (711) of the central plate in the direction perpendicular to said substantially linear parts being greater than a second dimension (712) in a direction parallel to said substantially linear parts, said second dimension defining the widths of the areas of said central plate, the average width of said central plate between the areas in which said central plate faces other plates, referred to as "lateral" plates (141, 145, 144, 148), connected to the other contacts of said three-pole capacitor being greater than one third of the average width of said central plate in said areas.

2. Insert according to claim 1, characterized in that, in at least one three-pole capacitor (141, 143, 145, 144, 146, 148), the average width (712) of said central plate (143, 146), between the areas in which it faces the lateral plates (141, 145, 144, 148), is greater than one third of the distance between the lateral plates.

3. Insert according to claim 1, characterized in that in at least one three-pole capacitor (141, 143, 145, 144, 146, 148) the minimum width (712) of said central plate (143, 146) between the areas in which said central plate faces the lateral plates (141, 145, 144, 148) is greater than one third of the average width of said central plate in said areas.

4. Insert according to claim 1, characterized in that in at least one three-pole capacitor (141, 143, 145, 144, 146, 148) the minimum width (712) of said central plate (143, 146) between the areas in which it faces the lateral plates (141, 145, 144, 148) is greater than one third of the distance between the lateral plates.

5. Insert according to claim 1, characterized in that in at least one three-pole capacitor (141, 143, 145, 144, 146, 148) the average width (712) of said central plate (143, 146) between the areas in which said central plate faces the lateral plates (141, 145, 144, 148) is greater than half the average width of said central plate in said areas.

6. Insert according to claim 1, characterized in that in at least one three-pole capacitor (141, 143, 145, 144, 146, 148) the average width (712) of the central plate (143, 146) between the areas in which it faces the lateral plates (141, 145, 144, 148) is greater than two thirds of the average width of said plate in said areas.

7. Insert according to claim 1, characterized in that in at least one three-pole capacitor (141, 143, 145, 144, 146, 148) the average width (712) of the central plate (143, 146) between the areas in which it faces the lateral plates (141, 145, 144, 148) is equal to the average width of said plate in said areas.

8. Insert according to claim 1, characterized in that in at least one three-pole capacitor (141, 143, 145, 144, 146, 148) the average width (712) of said central plate (143, 146) between the areas in which it faces the lateral plates (141, 145, 144, 148) is greater than half the distance between the lateral plates.

9. Insert according to claim 1, characterized in that in at least one three-pole capacitor (141, 143, 145, 144, 146, 148) the average width (712) of said central plate (143, 146) between the areas in which it faces the lateral plates (141, 145, 144, 148) is greater than two thirds of the distance between the lateral plates.

10. Insert according to claim 1, characterized in that in at least one three-pole capacitor (141, 143, 145, 144, 146, 148) the average width (712) of said central plate (143, 146) between the areas in which it faces the lateral plates (141, 145, 144, 148) is greater than or equal to the distance between the lateral plates.

11. Insert according to claim 1, characterized in that in at least one three-pole capacitor (141, 143, 145, 144, 146, 148) the minimum width (712) of said central plate (143, 146) between the areas in which said central plate faces the lateral plates (141, 145, 144, 148) is greater than half the average width of said central plate in said areas.

12. Insert according to claim 1, characterized in that in at least one three-pole capacitor (141, 143, 145, 144, 146, 148) the minimum width (712) of the central plate (143, 146) between the areas in which it places the lateral plates (141, 143, 144, 148) is greater than two thirds of the average width of said plate in said areas.

13. Insert according to claim 1, characterized in that in at least one three-pole capacitor (141, 143, 145, 144, 146, 148) the minimum width (712) of the central plate (143, 146) between the areas in which it faces the lateral plates (141, 145, 144, 148) is equal to the average width of said plate in said areas.

14. Insert according to claim 1, characterized in that in at least one three-pole capacitor (141, 143, 145, 144, 146, 148) the minimum width (712) of said central plate (143, 146) between the areas in which it faces the lateral plates (141, 145, 144, 148) is greater than half of the distance between the lateral plates.

15. Insert according to claim 1, characterized in that in at least one three-pole capacitor (141, 143, 145, 144, 146, 148) the average width (712) of said central plate (143, 146) between the areas in which it faces the lateral plates (141, 145, 144, 148) is greater than two thirds of the distance between the lateral plates.

16. Insert according to claim 1, characterized in that in at least one three-pole capacitor (141, 143, 145, 144, 146, 148) the average width (712) of said central plate (143, 146) between the areas in which it faces the lateral plates (141, 145, 144, 148) is greater than or equal to the distance between the lateral plates.

17. Insert according to claim 1, characterized in that in at least one three-pole capacitor (141, 143, 145, 144, 146, 148) the central plate (143, 146) is solid.

18. Insert according to claim 1, characterized in that it includes at least five consecutive contacts and at least one three-pole capacitor (141, 143, 145) between the first contact (101), the third contact (103) and the fifth contact (105).

19. Insert according to claim 1, characterized in that it includes eight consecutive contacts and at least one three-pole capacitor (144, 146, 148) between the fourth contact (104), the sixth contact (106) and the eighth contact (108).

20. Insert according to claim 1, characterized in that it includes means for separating the contacts into two spaced contact groups (110, 111), one of the groups including the even-number contacts and the other including the odd-number contacts.

21. Insert according to claim 1, characterized in that at least one three-pole capacitor (141, 143, 145, 144, 146, 148) includes a dielectric film (120, 130) placed between the plates.

22. Method of assembling an insert that includes a step (615) of assembling at least three contacts having substantially linear parts, characterized in that it further includes a step (605, 610) of producing at least one three-pole capacitor (141, 143, 145, 144, 146, 148) between three of said contacts (101, 103, 105, 104, 106, 108), one of the contacts (103, 106) of each three-pole capacitor being connected to a central plate (143, 146), a first dimension (711) of the central plate in the direction perpendicular to said substantially linear parts being greater than a second dimension (712) in a direction parallel to said substantially linear parts, said second dimension defining the widths of the areas of said central plate, the average width of said central plate between the areas in which said central plate faces other plates, referred to as "lateral" plates, connected to the other contacts of said three-pole capacitor being greater than one third of the average width of said central plate in said areas.

* * * * *